United States Patent [19]

Vignon

[11] Patent Number: 4,583,355

[45] Date of Patent: Apr. 22, 1986

[54] PROCESS FOR THE SPINNING OF FIBERS AND A DEVICE FOR CARRYING OUT THE PROCESS

[75] Inventor: Louis Vignon, Geneva, Switzerland

[73] Assignee: Heberlein Hispano S.A., Vernier/Geneve, Switzerland

[21] Appl. No.: 611,834

[22] Filed: May 18, 1984

[30] Foreign Application Priority Data

May 18, 1983 [CH] Switzerland ..... 2697/83

[51] Int. Cl.[4] ..... D02G 3/38

[52] U.S. Cl. ..... 57/5; 57/328

[58] Field of Search ..... 57/5, 6, 334, 401, 328, 57/12

[56] References Cited

U.S. PATENT DOCUMENTS

| | | | |
|---|---|---|---|
| 3,768,243 | 10/1973 | Brown et al. | 57/5 X |
| 3,772,873 | 11/1973 | Hino et al. | 57/334 X |
| 4,130,983 | 12/1978 | Dammann et al. | 57/5 |
| 4,222,222 | 9/1980 | Didek et al. | 57/5 X |
| 4,249,368 | 2/1981 | Fehrer | 57/5 |
| 4,274,250 | 6/1981 | Lippmann | 57/5 |
| 4,334,400 | 6/1982 | Fehrer | 57/401 X |
| 4,489,540 | 12/1984 | Faure et al. | 57/5 |

FOREIGN PATENT DOCUMENTS

| | | |
|---|---|---|
| 2065441 | 8/1973 | Fed. Rep. of Germany . |
| 2613263 | 9/1977 | Fed. Rep. of Germany . |
| 2656787 | 6/1978 | Fed. Rep. of Germany . |
| 2806991 | 10/1978 | Fed. Rep. of Germany . |
| 2809000 | 11/1978 | Fed. Rep. of Germany . |
| 615554 | 2/1980 | Switzerland . |
| 1231198 | 5/1971 | United Kingdom . |

*Primary Examiner*—Donald Watkins

*Attorney, Agent, or Firm*—Young & Thompson

[57] ABSTRACT

A twist is imparted to fiber slubbing (1) exiting from drawing rollers (2) by means of twister (4). Oriented, parallelized fibers (F) are applied to rotating fiber slubbing (1) in front of or within twister (4), the fibers (F) wrapping themselves around core thread (1). Because of these fibers (F), the twist of fiber slubbing (1) no longer unravels completely after twister (4), so that a spun thread (12) of great strength is obtained. The feed of fiber (F) to fiber slubbing (1) occurs by means of rotating feed element (8). It has a circular perforated surface (9), behind which a negative pressure is maintained to keep fibers (F) on the surface. The oriented, parallelized fibers (F) exit from drawing rollers (10) and are conveyed to perforated surface (9). The rotating fiber slubbing (1) comes into contact with surface (9) and then draws fibers (F) from surface (9). So that fibers (F) remain oriented and drawn during transfer, the speed of movement of perforated surface (9) is greater than the rate of feed of drawing rollers (10) and less than the circumferential speed of fiber slubbing (1).

12 Claims, 4 Drawing Figures

PROCESS FOR THE SPINNING OF FIBERS AND A DEVICE FOR CARRYING OUT THE PROCESS

Figure 1:
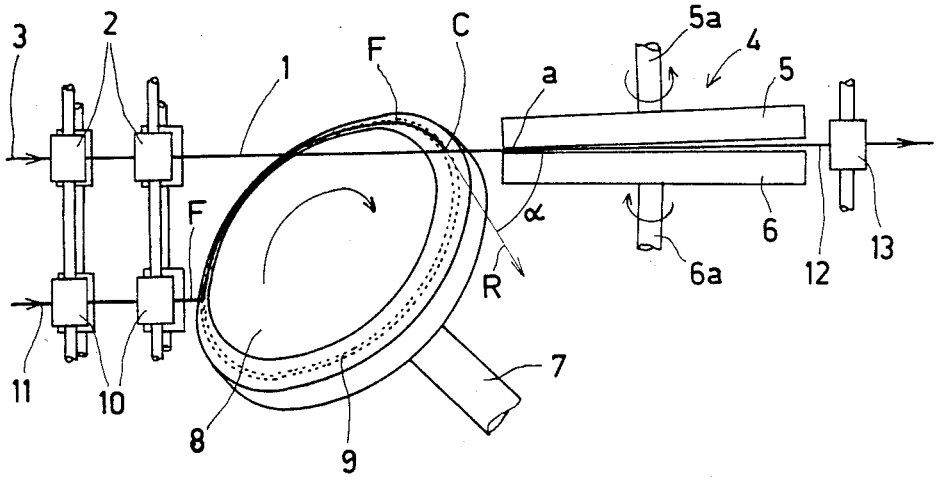

The introduction of loose fibers into the interspace between two surfaces, e.g., perforated cylinders, which are rotated in opposite directions, twisting the fibers to a thread or a fiber composite, is known (e.g. from DE-A-26 13 263, DE-A-26 56 787, DE-A-28 06 991, GB-A-1 231 198). In such instances, if desired, a core thread can also be introduced coaxially into the thread formation line between the surfaces, around which the fibers from the surfaces are wrapped.

In a further refinement of this process it has also been proposed (DE-A-28 09 000) to feed a core thread coaxially into the thread formation line, this thread consisting of a drawn fiber slubbing coming directly from drawing rollers. This core thread receives a twist from the surfaces rotating in opposite directions which is not completely unraveled after leaving the surfaces because of the fibers applied to the core thread by the surfaces.

In other known processes (e.g. DE-A-20 65 441 or, similarly, CH-A-615 554), free-flying fibers are fed to a rotating core thread by a twister. Here too, the fibers, which have been fed in, wrap around the core thread so that the twist imparted to the core thread is no longer fully unraveled after the twister.

All the known processes described exhibit the disadvantage that the loose or free-flying individual fibers fed in cannot, by their nature, have a common orientation and also cannot be drawn and wrapped on a core thread or a core; generally they are rolled on to the circumference of the core thread by oppositely rotating surfaces.

With respect to the strength and evenness of the thread so produced, particularly in the case of fine threads, it would be desirable for as many fibers as possible in the thread to be largely parallel and drawn.

The aim of the invention thus consists in developing a process for the spinning of fibers whereby a twist is imparted to an axially rotated core thread by a twister and whereby fibers are fed to this core thread in such a way that the fibers fed to the core thread, in the finished thread, are largely parallelized and drawn.

The aim is achieved, according to the invention, in a process of the type indicated, by feeding oriented, parallelized fibers to the rotating core thread either in front of or within the twister and, in doing so, restraining these fibers so that they are wound on the rotating core thread under tension.

The process according to the invention differs from the known processes primarily in that free-flying, loose individual fibers are not used for wrapping the core thread but, instead, fibers in an oriented, parallelized state are fed in, for example, in the form of a fiber slubbing coming from drawing rollers. In addition, these fibers are restrained during their feeding to the rotating core thread. The fibers which are drawn on the circumference of the rotating core thread thus remain drawn and maintain their parallel position.

As a core thread, one or more drawn fiber slubbings are preferably used, these coming directly from drawing rollers. It is also possible to use such drawn fiber slubbings together with a continuous filament. In this way, a core/sheath yarn with a continuous filament as a core thread can then be successfully produced even if the continuous filament has a very smooth surface.

The fibers are preferably fed roughly tangentially to the core thread. The drawn pickup of the fibers on the core thread is thereby especially effective if the fibers are fed to the core thread in a direction which forms an acute angle with the axial direction of movement of the core thread and whose component vertical to the axis of the core thread is directed against the circumferential speed of the core speed. Other fiber feed directions, including vertical to the axis of the core thread, are, however, also possible.

During their delivery to the rotating core thread, the fibers are restrained e.g. on a surface of a rotating feed mechanism with sufficient force so as not to impede delivery, yet producing the desired tension of the fibers. The force for holding the fibers to the feed mechanism can suitably be produced in such a way that an air-permeable surface is used and on whose rear side a low pressure can be maintained. Other forces can, of course, be used instead, e.g., electrostatic attraction.

A device for carrying out the process according to the invention, having a twister, a feed mechanism for feeding a core thread to the twister and means for feeding fibers to the core thread, is, according to the invention, characterized in that the fiber feed means exhibit at least one rotating feed element which exhibits a surface coming into contact with the circumferential surface of the core thread at a point between the feed mechanism and the twister or within the twister and means are provided for the feeding of oriented, parallelized fibers to this surface, as well as means for holding the fibers to the surface.

The feed element can advantageously be a component rotatable around an axis, on which the above mentioned surface runs circularly around the axis of rotation.

Figure 2:
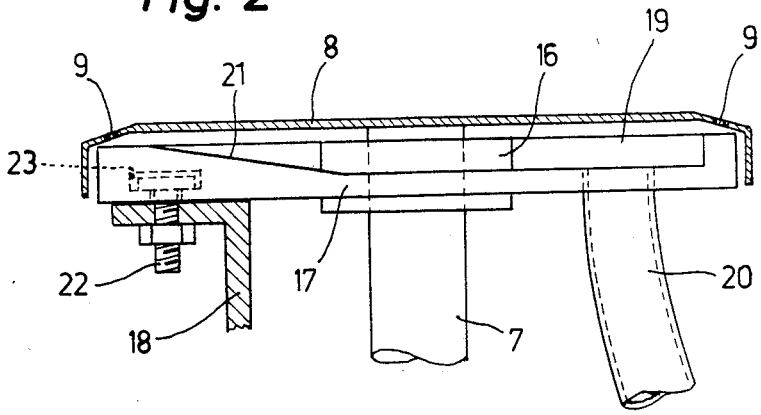
Figure 3:
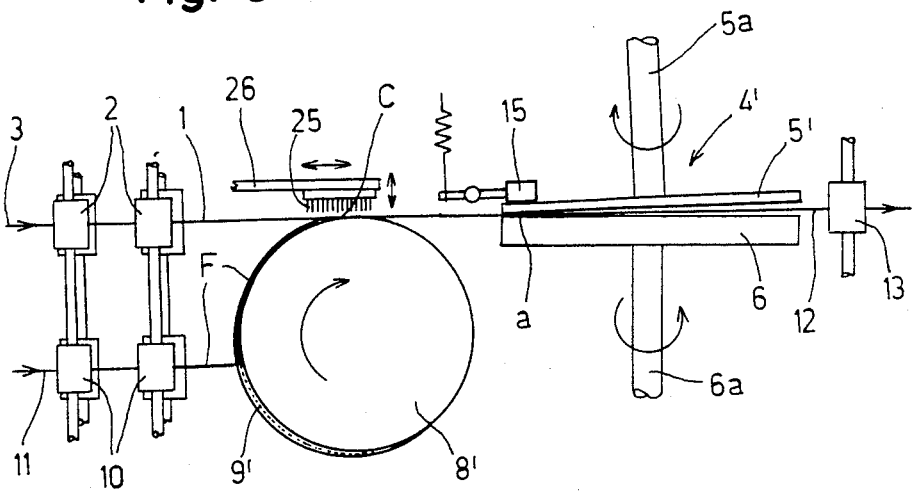
Figure 4:
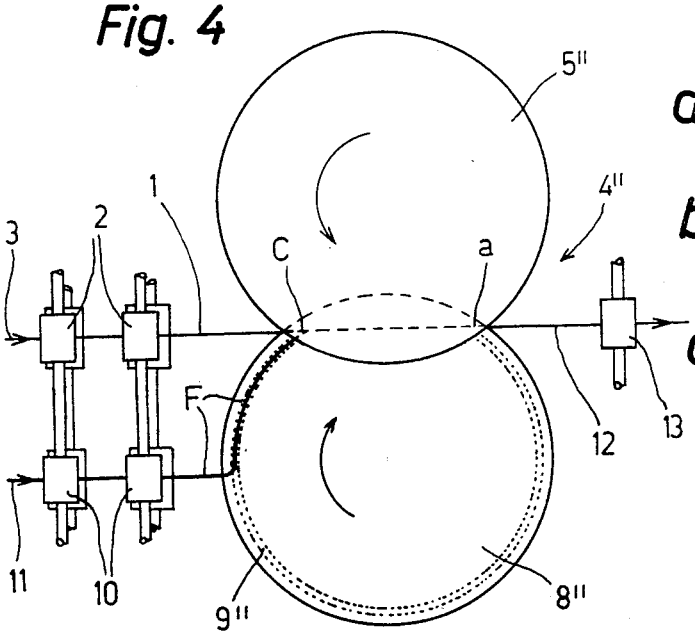
Figure 5:
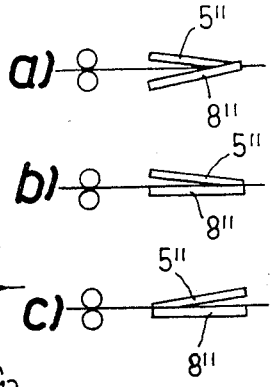

Examples of embodiments of the process according to the invention and of the device according to the invention are described more closely using the drawings which follow. Shown in the latter are:

FIG. 1 a device for the spinning of fibers, diagrammatically in plan view,

FIG. 2 details a fiber feed element applicable in the device of FIG. 1 in partially cut away diagrammatic view, FIG. 3 another embodiment of a device for the spinning of fibers in a view similar to that of FIG. 1, FIG. 4 similar view of a third embodiment of a device for spinning fibers and FIG. 5 various possible positionings of the two disks of the device in FIG. 4, shown in diagrammatic side views.

The devices shown in FIGS. 1, 3 and 4 each primarily contain a feed mechanism for a thread core 1, said feed mechanism having in the embodiment the form of drawing rollers 2 for a fiber slubbing 3 (or, optionally, two or three fiber slubbings). However, core thread 1 could also be a finished core thread (continuous filament or spun thread), in which case a simple thread feed device would be provided in place of the drawing rollers 2. It can also be particularly advantageous to feed both a continuous filament as well as at least a drawn fiber slubbing as core thread 1.

In the devices according to FIG. 1 or FIG. 3, the core thread 1 released by the feed device runs to a twister 4 or 4' which, in the example shown, consists of two opposed, approximately parallel disks 5, 6 or 5', 6', which rotate in opposite directions and contact the thread at a point on the circumference a and move it in rotation. Preferably axes 5a and 6a of the two friction disks are moved against each other perpendicularly to the axis of the thread (parallel to the plane of the drawing), so that they also exert a force on the thread in the feed direction at the point of contact a. In FIG. 1, the two friction disks 5 and 6 are, for practical purposes, rigid disks so that they can carry on their sides opposed to each other friction coatings of, e.g. polyurethane resin (not shown). In contrast, disk 5' shown in FIG. 3 is an elastic, flexible disk containing, e.g., of polyurethane resin and which presses, in the zone of the thread contact point a, against the other friction disk by means of one or more spring-loaded rollers 15 with adjustable force.

However, in place of the friction disks 5, 6 an additional twister could also be used. Twisters are known in the widest range of forms.

At a point C, lying at a distance in front of twister 4, or 4', oriented, parallelized fibers F are fed to the axially freely moving and rotating core thread 1, which, at the same time that they come in contact with the core thread and are picked up by the latter, are restrained in such a way that they are wrapped around the rotating core thread under tension. The fiber feed occurs by means of a rotating feed element represented as a rotatable hollow disk 8 or 8' with a shaft 7. Hollow disk 8 in FIG. 1 has a circular, conical, fiber retention surface 9 coaxial to shaft 7 and is placed and tilted in such a way that the circumferential surface of core thread 1 is at a tangent to this fiber retention surface 9 at point C. The fiber retention surface 9 is preferably air-permeable i.e. perforated and a negative pressure is maintained within hollow disk 8 at the rear side of surface 9 which restrains fibers F on surface 9 until they are picked up by the rotating core thread 1 and wrapped around it.

In accordance with FIG. 2, shaft 7 of hollow disk 8 can be seated in a rear seal element 17 attached to a stationary support 18. An air suction hose 20 terminates in the hollow space 19 surrounding the shaft bearing 16 between the rear seal element 17 and disk 8; the hose is connected to a negative pressure source (not shown) which maintains a negative pressure on the rear side of the perforated fiber retention surface 9. While a negative pressure is desired at the point where fibers F are picked up on the fiber retention surface 9, it can be desirable to reduce the negative pressure at fiber transfer point C in hollow disk 8. For this purpose seal element 17 can exhibit a surface which in the area of fiber transfer point C has a lesser distance from the rear side of perforated fiber retention surface 9 than in other areas. Such a surface of seal element 17 can also be placed at a slant as shown in the case of 21, so that by twisting seal element 17 around the axis of shaft 7 at a given point of the circumference, the distance between surface 21 and the rear side of fiber retention surface 9—and thus the suction effect on the particular point of surface 9—can be changed. To facilitate the twisting of seal element 17, it is fastened to support 18 with a screw 22, whose head lies in curved groove 23 around the axis of shaft bearing 16 within the seal element.

Hollow disk 8' in FIG. 3 can also exhibit a similar construction. It also has a circular fiber retention surface 9' which, however, is cylindrical and lies on the circumference of disk 8'. Fiber retention surface 9' is also fixed at a tangent to the circumferential surface of core thread 1 at point C.

At contact point C, the direction of movement R of surface 9 (FIG. 1) together with the axial direction of movement of core thread 1 forms a preferably acute angle $\alpha$, e.g. approximately 45° or between 30° and 60°. In FIG. 3, the angle between the direction of movement of surface 9' and the axial direction of movement of core thread 1 can be substantially less and, e.g., in the range of between 5° and 10°.

The rotational speed of surface 9 or 9' should be somewhat less than the rotational speed of rotating core thread 1 at contact point C, e.g., approximately 10 to 20% less, so that fed fibers F are not shoved onto the core thread but instead have to be drawn from surfaces 9 or 9'.

Core thread 1 is preferably drawn in such a direction that its circumferential speed at the side in contact with surfaces 9 or 9' is directed against direction R of the component vertical to the axis of core thread 1. R is the direction of movement of surface 9 or 9' at the point of contact C or the direction of the tangential feed of fibers F to core thread 1. In this way the fed fibers are not pinched between core thread 1 and surface 9, but, instead, are drawn off by the rotating core thread upwardly from surface 9 or 9'. Identical rotation of thread 1 and surface 9 or 9' is, however, also possible.

It can happen that the rear ends of individual fed fibers F, whose front ends have been picked up by the rotating core thread 1, can prematurely be released from the fiber retention surfaces 9 or 9'. To assure that even such fibers will be drawn and wrapped around core thread 1 approximately in the desired manner and orientation, a fiber pickup component for holding such rear fiber ends can be placed in the area of fiber transfer point C at a small distance (about 1 to 2 mm) from fiber retention surface 9 or 9'. Such a fiber pickup component is shown in FIG. 3 as a brush 25 attached to a support 26. As indicated by arrows, both the distance of brush 25 from core thread 1 or from fiber retention surface 9', as well as the position of the brush along core thread 1, are adjustable to facilitate an optimal adaptation to the type (e.g. length) of the fibers used.

FIG. 4 shows diagrammatically a simplified device for the spinning of fibers, in which rotating fiber feed disk 8'' serves simultaneously as one of two friction disks of twister 4''. Fiber feed disk 8'' has a circular fiber retention surface 9'' coaxial to its axis of rotation, which lies in the level frontal surface of the disk perpendicular to the axis of rotation. Fiber retention disk 9'' can be air-permeable (e.g. perforated), whereby a negative pressure can be maintained on its rear side, e.g., as explained from in connection with FIGS. 1 and 2.

Fiber feed disk 8'' is opposed by counterrotating friction disk 5''. Two disks 8'' and 5'' come in contact with the running thread at a circumferential point a and put it into rotation.

Oriented, parallelized fibers F from fiber retention surface 9'' are fed to axially moving and rotating core thread 1 at point C where the circumferential surface of the core thread comes into contact with fiber retention surface 9''. Fibers F are restrained by surface 9'', while they come into contact with the core thread and are picked up by the latter. The fibers are thus drawn and wrapped around the rotating core thread.

The inclination of disks 5'' and 8'' toward each other could also, as sketched in FIG. 5 at (a), be such that core thread 1 does not come into contact with fiber retention surface 9'' until the position a where the disks contact each other. Fiber transfer point C would thus, for practical purposes, be identical with contact point a. The sketch at (b) in FIG. 5 applies for the arrangement shown in FIG. 4, in which contact point a and fiber transfer point C are separated from each other. With an arrangement according to sketch (c) in FIG. 5, contact point a and fiber transfer point C are again identical, though now at the position where point C lies in FIG. 4.

Oriented, parallelized fibers F which are conveyed on surface 9, 9′ or 9″ to core thread 1 are fed to this surface 9, 9′ or 9″ preferably directly exiting from drawing rollers 10 which are fed with a fiber slubbing 11. This transfer of fibers F from drawing rollers 10 to surface 9, 9′ or 9″ should also take place under tension so that the fibers remain drawn and do not lose their orientation. This means that the fibers from drawing rollers 10 should not be shoved onto surfaces 9, 9′ or 9″, but should, instead, be drawn through them. The feed rate of drawing rollers 10 should thus be less the speed of movement of circular surface 9, 9′, 9″, e.g., about 10 to 20% less.

Thanks to the described shapes and arrangements of fiber retention and transfer surfaces 9, 9′, 9″, it is possible to arrange drawing roller assemblies 2 and 10 parallel or coaxial to each other, i.e. to feed fiber slubbings 3 and 11 from the same direction.

Core thread 1 with wrapped fibers F runs as a thread through twister 4, 4′, 4″ and to draw-off device 13. This latter can consist, in the usual way, of a power-driven metal roller and a rubber roller pressed against the former. Subsequently thread 12 can be wound in the usual way (not shown).

The twist imparted to the core thread by twister 4 or 4′ unravels only partially between the twister and the draw-off device 13 because of fibers F wrapped around the core thread. Thus, in the way described above, a spun thread 12 of great strength is produced even when core thread 1 is fed as a drawn fiber slubbing.

As mentioned above, an additional core thread can be incorporated into the primary core thread, preferably a continuous filament of high strength. Thanks to the drawn fiber slubbing also fed into the core thread there thus exists little danger, despite the smooth surface of the continuous filament, that wrapped fibers F in finished thread 12 will shift axially.

In the examples described above, covering fibers F are applied to core thread 1 using only one fiber feed element 8, 8′ or 8″; two or more similarly rotating feed elements could, of course, also be used to feed oriented, parallelized fibers to the core thread at several successive positions. In doing so, fibers of various types can also be fed.

What is claimed is:

1. A process for spinning fibers, comprising moving a core thread in an axial direction, imparting a twist to the core thread with a twister thereby to rotate the core thread, feeding oriented parallel fibers to the core thread in front of the twister in a direction forming an acute angle with the axial direction of movement of the core thread, and wrapping the fibers under tension on the rotating core thread.

2. A device for spinning fibers, comprising a twister, a feed device for feeding a core thread to the twister, means for feeding fibers to the core thread, said means for feeding fibers comprising at least one rotating feed element which has a surface tangential to the core thread at a point between the core thread feed device and the twister, means for feeding oriented parallel fibers to said surface, and means attracting the fibers to the surface thereby to wind the fibers about the core thread under tension.

3. A device as claimed in claim 2, and a fiber pick-up element which is disposed adjacent the contact point between said surface and the core thread on the opposite side of said surface from the core thread thereby to restrain the rear end of fibers whose forward ends have been picked up by the core thread.

4. A device as claimed in claim 2, in which said attracting means comprise suction means that act on the fibers through holes through said surface.

5. A device as claimed in claim 2, in which said surface at the point of said tangency has a direction of movement that forms an acute angle with the axis of the core thread.

6. A device as claimed in claim 2, and means to adjust the amount of suction applied through said holes, the last-named means comprising an adjustment element disposed on the side of said surface opposite the core thread, and means to change the distance between said rear side and said adjustment element adjacent the point of said tangency.

7. A device as claimed in claim 2, in which said adjustment element has a surface that faces said holes but is inclined to a plane perpendicular to the axis of rotation of said rotating feed element, and means to rotate said adjustment element relative to said holes.

8. A process for the spinning of fibers, comprising moving a first fiber slubbing through a first set of drawing rollers, moving a second drawn fiber slubbing with its fibers oriented in parallel through a second set of drawing rollers, applying the second slubbing to a rotating retention surface, attracting the second slubbing to said retention surface, moving said second slubbing on said retention surface to a point at which said surface is tangent to said first slubbing, and wrapping said second slubbing about said first slubbing under tension imposed by the attraction of the retention surface for the second slubbing.

9. A process as claimed in claim 8, and attracting said second slubbing to said retention surface by providing a plurality of holes through said retention surface and establishing a vacuum on the side of said holes opposite said second slubbing.

10. A process as claimed in claim 8, and rotating said retention surface in a direction such that said second slubbing contacts said first slubbing at an acute angle to the direction of movement of said first slubbing.

11. A device for spinning fibers, comprising a twister, a feed mechanism including a first set of drawing rollers for feeding a drawn fiber slubbing to the twister, a second set of drawing rollers, common axle means on which said first and second drawing rollers are mounted, and a rotatable fiber retention surface onto which a second drawn fiber slubbing is fed by said second set of drawing rollers, said retention surface being tangent to said first slubbing.

12. A device as claimed in claim 11, said retention surface forming an acute angle with the axis of said first slubbing at the point of tangency of said surface with said first slubbing.

* * * * *